US007384445B2

(12) United States Patent
Skoglund et al.

(10) Patent No.: US 7,384,445 B2
(45) Date of Patent: Jun. 10, 2008

(54) SINTERED METAL PARTS AND METHOD FOR THE MANUFACTURING THEREOF

(75) Inventors: Paul Skoglund, Höganäs (SE); Mikhail Kejzelman, Malmö (SE); Anders Bergmark, Viken (SE)

(73) Assignee: Höganäs AB, Höganäs (SE)

( * ) Notice: Subject to any disclaimer, the term of this patent is extended or adjusted under 35 U.S.C. 154(b) by 51 days.

(21) Appl. No.: 11/108,832

(22) Filed: Apr. 19, 2005

(65) Prior Publication Data

US 2005/0238523 A1 Oct. 27, 2005

Related U.S. Application Data

(60) Provisional application No. 60/570,100, filed on May 12, 2004.

(30) Foreign Application Priority Data

Apr. 21, 2004 (SE) ..... 0401041

(51) Int. Cl.
*B22F 3/10* (2006.01)
*B22F 3/12* (2006.01)

(52) U.S. Cl. ..... 75/246; 75/243; 419/23; 419/28; 419/36; 419/39; 419/58; 419/60

(58) Field of Classification Search ..... 419/28, 419/36, 39, 58, 60, 23; 75/246, 243
See application file for complete search history.

(56) References Cited

U.S. PATENT DOCUMENTS

| | | | |
|---|---|---|---|
| 5,540,883 | A | 7/1996 | Jones et al. |
| 5,552,109 | A | 9/1996 | Shivanath et al. |
| 5,613,180 | A | 3/1997 | Kosco |
| 5,711,187 | A | 1/1998 | Cole et al. |
| 5,729,822 | A | 3/1998 | Shivanath et al. |
| 5,754,937 | A | 5/1998 | Jones et al. |
| 6,171,546 | B1 | 1/2001 | MÅrs et al. |
| 7,238,220 | B2 * | 7/2007 | Kejzelman et al. ..... 75/252 |
| 2004/0177719 | A1 | 9/2004 | Kosco |
| 2005/0244295 | A1 | 11/2005 | Skoglund et al. |

FOREIGN PATENT DOCUMENTS

| | | |
|---|---|---|
| JP | 03130349 A | 6/1991 |
| WO | WO 94/14557 | 7/1994 |
| WO | 2004/037467 A | 5/2004 |
| WO | 2005/102565 A | 11/2005 |

OTHER PUBLICATIONS

Broszeit, E. et al., "Surface Rolling of Sintered Materials", Horizon and Powder Metallurgy Part 1, pp. 403-406, Proceedings of the 1986 International Powder Metallurgy Conference and Exhibition Dousseldorf, Jul. 7-11, 1986.
Lipp, Klaus et al., "Design for Rolling Contact Fatigue", International Journal of Powder Metallurgy, vol. 39, No. 1, pp. 33-46, 2003.
"Surface Rolling of Sintered Gears", Y. Takeya et al., SAE Technical Paper Series 820234, International Congress & Exposition, Detroit, Michigan, pp. 1 to 9. (Feb. 22-26, 1982).
"How to Improve the Fatigue Properties of Sintered Steels by Combined Mechanical and Thermal Surface Treatments", C.M. Sonsino et al., Modern Developments in Powder Metallurgy, vol. 16, pp. 33 to 48 (1984).
International Preliminary Report on Patentability dated Nov. 14, 2006 for PCT/US2005/016594.

* cited by examiner

*Primary Examiner*—Roy King
*Assistant Examiner*—Ngoclan T Mai
(74) *Attorney, Agent, or Firm*—Buchanan Ingersoll & Rooney PC

(57) ABSTRACT

The invention concerns a sintered metal part which has a densified surface and sintered density of at least 7.35 g/cm$^3$ and a core structure distinguished by a pore structure obtained by single pressing to at least 7.35 g/cm$^3$ and single sintering of a mixture of a coarse iron or iron-based powder and optional additives.

22 Claims, 4 Drawing Sheets

SINTERED METAL PARTS AND METHOD FOR THE MANUFACTURING THEREOF

The benefit is claimed under 35 U.S.C. § 119(a)-(d) of Swedish Application No. 0401041-9, filed Apr. 21, 2004, and under 35 U.S.C. § 119(e) of U.S. Provisional Application No. 60/570,100, filed May 12, 2004.

FIELD OF THE INVENTION

The invention relates to powder metal parts. Specifically the invention concerns sintered metal parts which have a densified surface and which are suitable for demanding applications. The invention also includes a method of preparing these metal parts.

BACKGROUND OF THE INVENTION

There are several advantages by using powder metallurgical methods for producing structural parts compared with conventional matching processes of full dense steel. Thus the energy consumption is much lower and the material utilization is much higher. Another important factor in favour of the powder metallurgical route is that components with net shape or near net shape can be produced directly after the sintering process without costly shaping such as turning, milling, boring or grinding. However, normally a full dense steel material has superior mechanical properties compared with PM components. Therefore, the strive has been to increase the density of PM components in order to reach values as close as possible to the density value of a full dense steel.

One area of future growth in the utilization of powder metal parts having high density is in the automotive industry. Of special interest within this field is the use of powder metal parts in more demanding applications, such as power transmission applications, for example, gear wheels. Problems with gear wheels formed by the powder metal process are that powder metal gear wheels have reduced bending fatigue strength in the tooth root region of the gear wheel, and low contact fatigue strength on the tooth flank compared with gears machined from bar stock or forgings. These problems may be reduced or even eliminated by plastic deformation of the surface of the tooth root and flank region through a process commonly known as surface densification. Products which can be used for these demanding applications are described in e.g. the U.S. Pat. Nos. 5,711,187, 5,540,883, 5,552,109, 5,729,822 and 6,171,546.

The U.S. Pat. No. 5,711,187 (1990) is particularly concerned with the degree of surface hardness, which is necessary in order to produce gear wheels which are sufficiently wear resistant for use in heavy duty applications. According to this patent the surface hardness or densification should be in the range of 90 to 100 percent of full theoretical density to a depth of at least 380 microns and up to 1,000 microns. No specific details are disclosed concerning the production process but it is stated that admixed powders are preferred as they have the advantage of being more compressible, enabling higher densities to be reached at the compaction stage. Furthermore it is stated that the admixed powders should include in addition to iron and 0.2% by weight of graphite, 0.5% by weight of molybdenum, chromium and manganese, respectively.

A method similar to that described in the U.S. Pat. No. 5,711,187 is disclosed in the U.S. Pat. No. 5,540,883 (1994).

According to the U.S. Pat. No. 5,540,883 bearing surfaces from powder metal blanks are produced by blending carbon and ferro alloys and lubricant with compressible elemental iron powder, pressing the blending mixture to form the powder metal blank, high temperature sintering the blank in a reducing atmosphere, compressing the powder metal blanks so as to produce a densified layer having a bearing surface, and then heat treating the densified layer. The sintered powder metal article should have a composition, by weight percent, of 0.5 to 2.0% chromium, 0 and 1.0% molybdenum, 0.1 and 0.6% carbon, with a balance of iron and trace impurities. Broad ranges as regards compaction pressures are mentioned. Thus it is stated that the compaction may be performed at pressures between 25 and 50 ton per square inch (about 390-770 MPa).

The U.S. Pat. No. 5,552,109 (1995) patent concerns a process of forming a sintered article having high density. The patent is particularly concerned with the production of connecting rods. As in the U.S. Pat. No. 5,711,187 no specific details concerning the production process are disclosed in the U.S. Pat. No. 5,552,109 but it is stated that the powder should be a pre-alloyed iron based powder, that the compacting should be performed in a single step, that the compaction pressures may vary between 25 and 50 ton per square inch (390-770 MPa) to green densities between 6.8 and 7.1 g/cm$^3$ and that the sintering should be performed at high temperature, particularly between 1270 and 1350° C. It is stated that sintered products having a density greater than 7.4 g/cm$^3$ are obtained and it is thus obvious that the high sintered density is a result of the high temperature sintering.

In the U.S. Pat. No. 5,729,822 (1996) a powder metal gear wheel having a core density of at least 7.3 g/cm$^3$ and a hardened carburized surface is disclosed. The powders recommended are the same as in the U.S. Pat. Nos. 5,711,187 and 5,540,883 i.e. mixtures obtained by blending carbon, ferro alloys and lubricant with compressible a powder of elemental iron. In order to obtain high sintered core density the patent mentions warm pressing; double pressing, double sintering; high density forming as disclosed in the U.S. Pat. No. 5,754,937; the use of die wall lubrication, instead of admixed lubricants during powder compaction; and rotary forming after sintering. Compacting pressures of around 40 tons per square inch (620 MPa) are typically employed.

The surface densification of sintered PM steels is discussed in e.g. the Technical Paper Series 820234, (International Congress & Exposition, Detroit, Mich., Feb. 22-26, 1982). In this paper a study of surface rolling of sintered gears is reported. Fe—Cu—C and Ni—Mo alloyed materials were used for the study. The paper reveals the results from basic research on the surface rolling of sintered parts at a density of 6.6 and 7.1 g/cm$^3$ and the application of it to sintered gears. The basic studies includes surface rolling with different diameters of the rolls, best results in terms of strength were achieved with smaller roll diameter, lesser reduction per pass and large total reduction. As an example for a Fe—Cu—C material a densification of 90% of theoretical density was achieved with a roll of 30 mm diameter to a depth of 1.1 mm. The same level of densification was achieved to a depth of about 0.65 mm for a 7.5 mm diameter roll. The small diameter roll however was able to increase the densification to about full density at the surface whereas the large diameter roll increased the density to about 96% at the surface. The surface rolling technique was applied to sintered oil-pumps gears and sintered crankshaft gears. In an article in Modern Developments in Powder Metallurgy, Volume 16, p. 33-48 1984 (from the International PM Conference Jun. 17-22, 1984, Toronto Canada,) the authors have investigated the influence of shot-peening, carbonitriding and combinations thereof on the endurance limit of sintered Fe+1.5% Cu and Fe+2% Cu+2.5% Ni alloys. The density reported of these alloys were 7.1 and 7.4 g/cm$^3$. Both a theoretical evaluation of the surface rolling process and a bending fatigue testing of surface rolled parts is published in an article in Horizon of Powder Metallurgy part I, p. 403-406. Proceedings of the 1986 (International Powder Metallurgy Conference and Exhibition, Dusseldorf, 7-11 Jul. 1986).

According to the prior art many different routes have been suggested in order to reach high sintered density of a powder metallurgical component. However, the suggested processes all include steps adding additional costs. Thus warm compaction and die wall lubrication promote high green density. Double pressing and double sintering result in high sintered density and shrinkage as a result of high temperature sintering also results in high sintered density.

Furthermore, for high load applications such as gear wheels, special precautions has to be taken in account regarding the pore size and pore morphology in order to achieve sufficient fatigue properties. A simple and cost effective method for the preparation of gear wheels and similar products with a high sintered density and mechanical strength, regardless the pore size and morphology, would thus be attractive and the main object of the present invention.

SUMMARY OF THE INVENTION

In brief it has now been found that powder metal parts in more demanding applications, such as power transmission applications, for example, gear wheels, can be obtained by subjecting an iron or iron-based powder to unaxially compaction at a pressure above 700 MPa to a density above 7.35 g/cm$^3$, sintering the obtained green product and subjecting the sintered product to a densification process. A characteristic feature of the core of the metal part according to the invention is the pore structure, which is distinguished by comparatively large pores.

Specifically the invention concerns a sintered metal part which has a densified surface and a core density of at least 7.35, preferably at least 7.45 g/cm$^3$ wherein the core structure is distinguished by a pore matrix obtained by single pressing, without applying die wall lubrication, to at least 7.35 g/cm$^3$, preferably at least 7.45 g/cm$^3$, and single sintering of an iron-based powder mixture having coarse iron or iron-based powder particles as well as the method of producing such metal parts. The pore structure was measured an evaluated by using image analysis according to ASTM E 1245 giving the pore area distribution related to pore size.

The density levels above concerns products based on pure or low-alloyed iron powder.

DETAILED DESCRIPTION OF THE INVENTION

Powder Types

Suitable metal powders which can be used as starting materials for the compaction process are powders prepared from metals such as iron. Alloying elements such as carbon, chromium, manganese, molybdenum, copper, nickel, phosphorous, sulphur etc can be added as particles, prealloyed or diffusion alloyed in order to modify the properties of the final sintering product. The iron-based powders can be selected from the group consisting of substantially pure iron powders, pre-alloyed iron-based particles, diffusion alloyed iron-based iron particles and mixture of iron particles or iron-based particles and alloying elements. As regards the particle shape it is preferred that the particles have an irregular form as is obtained by water atomisation. Also sponge iron powders having irregularly shaped particles may be of interest.

As regards PM parts for high demanding applications, especially promising results have been obtained with pre alloyed water atomised powders including low amounts such as up to 5% of one or more of the alloying elements Mo and Cr. Examples of such powders are powders having a chemical composition corresponding to the chemical composition of Astaloy Mo (1.5% Mo and Astaloy 85 Mo (0.85% Mo) as well as Astaloy CrM (3 Cr, 0.5 Mo) and Astaloy CrL (1.5 Cr, 0.2 Mo) from Höganäs AB, Sweden.

A critical feature of the invention is that the powder used have coarse particles i.e. the powder is essentially without fine particles. The term "essentially without fine particles" is intended to mean that less than about 10%, preferably less than 5% of the powder particles have a size below 45 μm as measured by the method described in SS-EN 24 497. The average particle diameter is typically between 75 and 300 μm. The amount of particles above 212 μm is typically above 20%. The maximum particle size may be about 2 mm.

The size of the iron-based particles normally used within the PM industry is distributed according to a gaussian distribution curve with a average particle diameter in the region of 30 to 100 μm and about 10-30% of the particles are less than 45 μm. Thus the powders used according to the present invention have a particle size distribution deviating from that normally used. These powders may be obtained by removing the finer fractions of the powder or by manufacturing a powder having the desired particle size distribution.

Thus for the powders mentioned above a suitable particle size distribution for a powder having a chemical composition corresponding to the chemical composition of Astaloy 85 Mo could be that at most 5% of the particles should be less than 45 μm and the average particle diameter is typically between 106 and 300 μm. The corresponding values for a powder having a chemical composition corresponding to Astaloy CrL are suitably that less than 5% should be less than 45 μm and the average particle diameter is typically between 106 and 212 μm.

In order to obtain sintered metal parts having satisfactory mechanical sintered properties according to the present invention it may be necessary to add graphite to the powder mixture to be compacted. Thus, graphite in amounts between 0.1-1, preferably 0.2-1.0, more preferably 0.2-0.7% and most preferably 0.2-0.5% by weight of the total mixture to be compacted could be added before the compaction. However, for certain applications graphite addition is not necessary.

The iron-base powder may also be combined with a lubricant before it is transferred to the die (internal lubrication). The lubricant is added in order to minimize friction between the metal power particles and between the particles and the die during a compaction, or pressing, step. Examples of suitable lubricants are e.g. stearates, waxes, fatty acids and derivatives thereof, oligomers, polymers and other organic substances with lubricating effect. The lubricants may be added in the form of particles but may also be bonded and/or coated to the particles.

Preferably a lubricating coating of a silane compound of the type disclosed in WO 2004/037467 is included in the powder mixture. Specifically the silane compound may be an alkylakoxy or polyetheralkoxy silane, wherein the alkyl group of the alkylalkoxy silane and the polyether chain of the polyetheralkoxy silane include between 8 and 30 carbon atoms, and the alkoxi group includes 1-3 carbon atoms. Examples of such compounds are octyl-tri-metoxy silane, hexadecyl-tri-metoxy silane and polyethyleneether-trimetoxy silane with 10 ethylene ether groups.

According to the present invention the amount of lubricant added to the iron-based powder may vary between 0.05 and 0.6%, preferably between 0.1-0.5% by weight of the mixture.

As optional additives hard phases, binding agents, machinability enhancing agents and flow enhancing agents may be added.

Compaction

Conventional compaction at high pressures, i.e. pressures above 600 MPa with conventionally used powders including finer particles, in admixture with low amounts of lubricants (less than 0.6% by weight) is generally considered unsuitable due to the high forces required in order to eject the compacts from the die, the accompanying high wear of the die and the fact that the surfaces of the components tend to be less shiny or deteriorated. By using the powders according to the present invention it has unexpectedly been found that the ejection force is reduced at high pressures and that components having acceptable or even perfect surfaces may be obtained also when die wall lubrication is not used.

The compaction may be performed with standard equipment, which means that the new method may be performed without expensive investments. The compaction is performed uniaxially in a single step at ambient or elevated temperature. Preferably the compaction pressures are above about 700, more preferably above 800 and most preferably above 900 or even 1000 MPa. In order to reach the advantages with the present invention the compaction should preferably be performed to densities above 7.45 g/cm$^3$.

Sintering

Any conventional sintering furnace may be used and the sintering times may vary between about 15 and 60 minutes. The atmosphere of the sintering furnace may be an endogas atmosphere, a mixture between hydrogen and nitrogen or in vacuum. The sintering temperatures may vary between 1100 and 1350° C. With sintering temperatures above about 1250° C. the best results are obtained. In comparison with methods involving double pressing and double sintering the method according to the present invention has the advantage that one pressing step and one sintering step are eliminated and still sintered densities above 7.64 g/cm$^3$ can be obtained.

Structure

A distinguishing feature of the core of the high density green and sintered metal part is the presence of large pores. Thus, as an example, in a cross section of the core of a sintered metal part according to the invention, at least about 50% of the pore area consists of pores having a pore area of at least 100 μm$^2$, whereas, in a cross section of a core prepared from a corresponding normal powder (i.e. a powder including normal amounts of fine particles which has to be double pressed and double sintered in order to reach the same density), at least about 50% of the pore area consists of pores having a pore area of about 65 μm$^2$.

Surface Densification

The surface densification may be performed by radial or axial rolling, shoot peening, sizing etc. A preferred method is radial rolling as this method provides short cycle times in combination with great densification depth. The powder metal parts will obtain better mechanical properties with increasing densifying depth. The densification depth is preferably at least 0.1 mm, preferably at least 0.2 mm and most preferably at least 0.3 mm.

In this context is should be recalled that normally the presence of large pores in sintered parts is regarded as a drawback and different measures are taken in order to make the pores smaller and rounder. According to the present invention, however, it has surprisingly been found that the negative effect of the comparatively high amount of larger pores can be totally eliminated by a surface densification process. Thus, when comparing the effect of surface densification on the bending fatigue strength of sintered samples containing larger pores in the core with the effect on samples containing smaller pores, it has been found that the surface densification process increases the bending fatigue strength to a much higher extent when the samples are produced from metal powder with the particle size distribution discussed above. After the surface densification process, the bending fatigue strength of samples produced of these powders will surprisingly reach the same level as that of surface densified samples which are produced from powders having a normal particle size distribution (given the same chemical composition and the same sintered density level). Accordingly, as high sintered density can be reached in a single pressing, single sintering process, costly processes, such as double pressing-double sintering, warm compaction, can be avoided by utilising the method according to the present invention for production of for example gear wheels.

Figure 1:
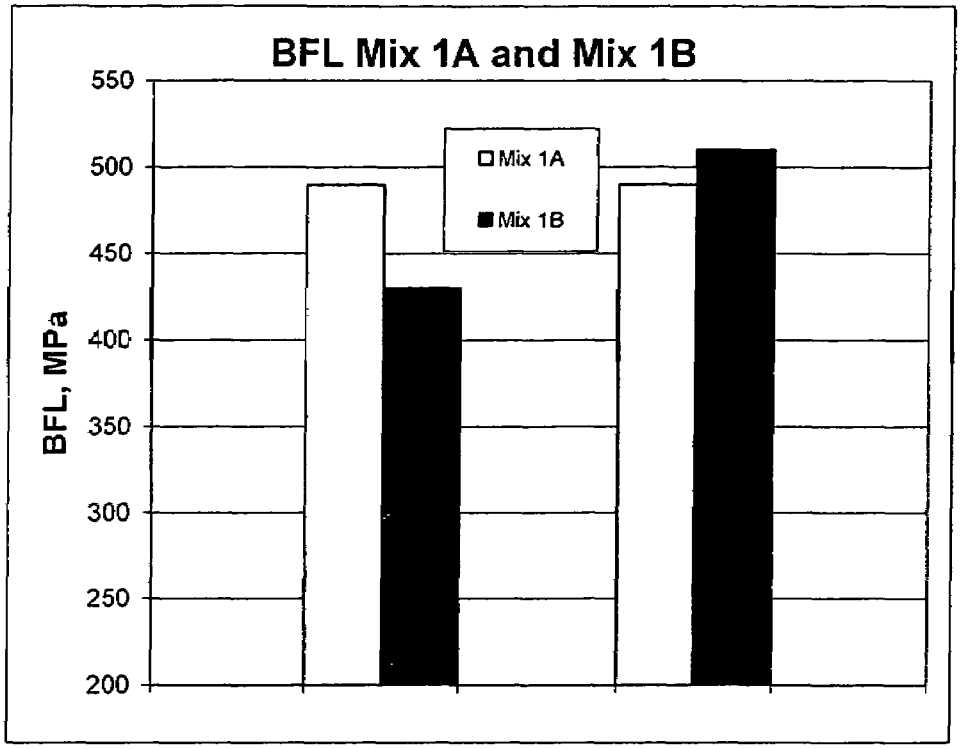
FIG. 1 shows the bending fatigue strength before and after the surface densification process of samples produced from the mixes 1A and 1B according to example 1.

The invention is further illustrated by the following non-limiting examples.

The following iron-based powders were used;

Powder A;

Astaloy 85 Mo, an atomised pre-alloyed iron base powder with a Mo content of 0.80-0.95%, a carbon content of at most 0.02% and an oxygen content of at most 0.20%.

The particle sized distribution of powder A is similar to the particle size distribution for powder normally used in powder metallurgy; about 0% greater than 250 μm, about 15-25% between 150 and 250 μm and about 15 to 30% less than 45 μm.

Powder B;

The same chemical composition as powder A but with a coarser particle size distribution according to the table below;

| Particle size μm | % by weight |
|---|---|
| >500 | 0 |
| 425-500 | 1.9 |
| 300-425 | 20.6 |
| 212-300 | 27.2 |
| 150-212 | 20.2 |
| 106-150 | 13.8 |
| 75-106 | 6.2 |
| 45-75 | 5.9 |
| <45 | 4.2 |

Powder C;

Astaloy CrL, an atomised Mo—, Cr— prealloyed iron based powder with a Cr content of 1.35-1.65%, a Mo content of 0.17-0.27%, a carbon content of at most 0.010% and an oxygen content of at most 0.25%.

The particle sized distribution of powder C is similar to the particle size distribution for powder normally used in powder metallurgy; about 0% greater than 250 μm, about 15-25% between 150 and 212 μm and about 10 to 25% less than 45 μm.

Powder D;

The same chemical composition as powder C but with a coarser particle size distribution according to the table below;

| Particle size μm | % by weight |
|---|---|
| >500 | 0 |
| 425-500 | 0.2 |
| 300-425 | 7.4 |
| 212-300 | 21.9 |
| 150-212 | 25.1 |
| 106-150 | 23.4 |
| 75-106 | 11.2 |
| 45-75 | 7.1 |
| <45 | 3.7 |

EXAMPLE 1

Two mixes, Mix 1A and Mix 1B were prepared by thoroughly mixing before compaction.

Mix 1A was based on powder A with an addition of 0.2% by weight of graphite and 0.8% by weight of H wax.

Mix 1B was based on powder B with an addition of 0.2% by weight of graphite and 0.2% by weight of hexadecyl trimetoxy silane.

FS-strength test bars according to ISO 3928 were compacted.

Test bars based on Mix 1A was compacted to a green density of 7.1 g/cm$^3$ and pre sintered at 780° C. for 30 minutes in an atmosphere of 90% nitrogen and 10% hydrogen. After sintering the samples were subjected to a second compaction at a pressure of 1100 MPa and finally sintered at 1280° C. for 30 minutes in an atmosphere of 90% nitrogen and 10% of hydrogen. The sintered density was measured to 7.61 g/cm$^3$.

The sample prepared from mix 1B was compacted in a single compaction process at 1100 MPa was subsequently sintered at 1280° C. for 30 minutes in an atmosphere of 90% nitrogen and 10% of hydrogen. The sintered density was 7.67 g/cm$^3$.

The results are summarized in table 1 below.

TABLE 1

| MIX | POWDER | Pressure MPa/GD | Sintering ° C. | Pressure MPa | Sintering ° C. | SD g/cm$^3$ |
|---|---|---|---|---|---|---|
| 1A | Astaloy 85<br>0.80-0.95 Mo standard<br>0.2 graphite | 7.1 | 780 | 1100 | 1280 | 7.61 |
| 1B | Astaloy 85<br>0.80-0.95 Mo coarse<br>0.2 graphite | | | 1100 | 1280 | 7.67 |

Half of the number of the obtained sintered bodies was subjected to a surface densifaction process by shot peening at 6 bars air pressure with steel spheres with a diameter of 0.4 mm.

Both the surface densified samples and the samples not subjected to a surface densification process were case hardened at 920° C. for 75 minutes at a carbon potential of 0.8% followed by a tempering operation at 200° C. for 120 minutes.

Bending fatigue limit (BFL) was determined for all of the samples.

FIG. 1 shows the bending fatigue limit for both the surface densified samples and the samples which were not subjected to surface densification.

From FIG. 1 it can be concluded that surface densification of the samples produced with the coarser powder contributes to a much higher increase in BFL compared with the increase in BFL which was obtained by surface densification of the samples produced with a powder having a conventional particle size distribution.

Figure 2:
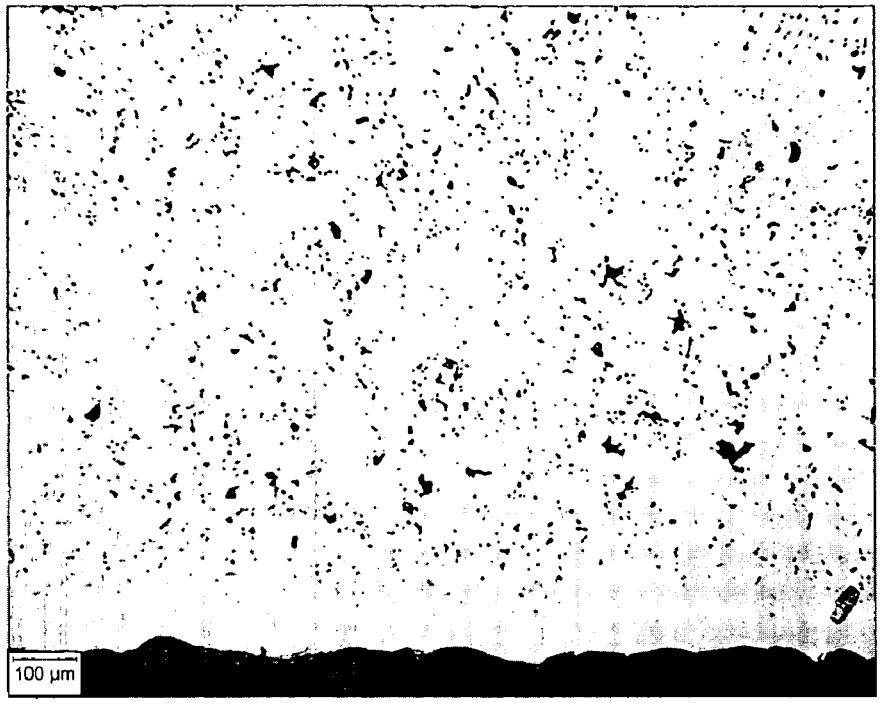
FIG. 2 is a light optical micrograph of a cross section of a surface densified sample prepared from mix 1A.
Figure 3:
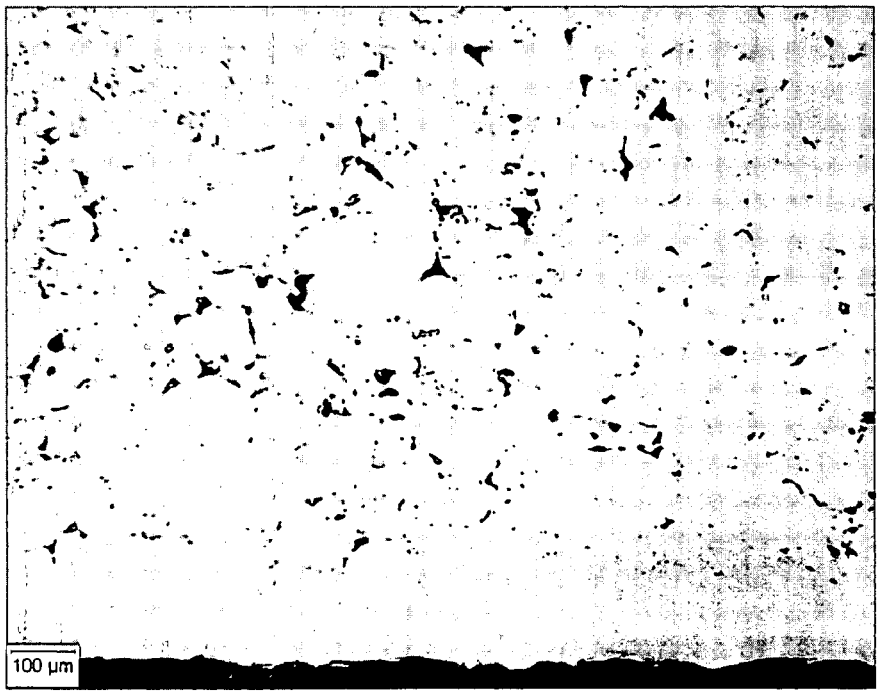
FIG. 3 is a light optical micrograph of a cross section of a surface densified sample prepared from mix 1B.

FIG. 2 is a light optical micrograph showing a cross section of a surface densified sample prepared from mix 1A and FIG. 3 is a similar micrograph from a surface densified sample prepared from mix 1B.

Image analysis according to ASTM E 1245 of cross section of surface densified samples produced from sample 1A shows that about 50% of the total cross section pore area consists of pores having a surface area of 65 μm$^2$ or more, whereas the same measuring of surface densified samples produced from mix 1B shows that about 50% of the total cross section area consists of pores having a surface area of 200 μm$^2$ or more.

EXAMPLE 2

Two mixes, Mix 2C and Mix 2D were prepared by thoroughly mixing before compaction.

Mix 2C was based on powder C with an addition of 0.7% of nickel powder, 0.2% by weight of graphite and 0.8% by weight of H wax, Mix 2D was based on powder D with an addition of 0.7% of nickel powder 0.2% of graphite and 0.2% of hexadecyl trimetoxy silane.

FS-strength test bars according to ISO 3928 were prepared.

Test bars based on mix 2C, was compacted to a green density of 7.1 g/cm$^3$ and pre sintered at 780° C. for 30 minutes in an atmosphere of 90% nitrogen and 10% hydrogen. After sintering the samples were subjected to a second compaction at a pressure of 1100 MPa and finally sintered at 1280° C. for 30 minutes in an atmosphere of 90% nitrogen and 10% of hydrogen. The sintered density was measured to 7.63 g/cm$^3$.

Test bars prepared from mix 2D was compacted in a single compaction process at 1100 MPa followed by sintering 1280° C. for 30 minutes in an atmosphere of 90% nitrogen and 10% of hydrogen. The sintered density was measured to 7.64 g/cm$^3$.

The results are summarized in table 3 below.

TABLE 3

| MIX | POWDER | Pressure MPa/GD | Sintering ° C. | Pressure MPa | Sintering ° C. | SD g/cm$^3$ |
|---|---|---|---|---|---|---|
| 2C | CRL Standard 1.35-1.65 Cr 0.17-0.27 Mo + 0.7% Ni | 7.1 | 780 | 1100 | 1280 | 7.63 |
| 2D | CRL Coarse 1.35-1.65 Cr 0.17-0.27 Mo + 0.7% Ni | | | 1200 | 1280 | 7.64 |

Half of the number of the obtained sintered bodies were subjected to a surface densification process by shot peening at 6 bars air pressure with steel spheres with a diameter of 0.4 mm.

Both the surface densified samples and the samples not subjected to a surface densifaction process were case hardened at 920° C. for 75 minutes at a carbon potential of 0.8% followed by a tempering operation at 200° C. for 120 minutes.

Bending fatigue limit (BFL) were determined for all of the samples.

Figure 4:
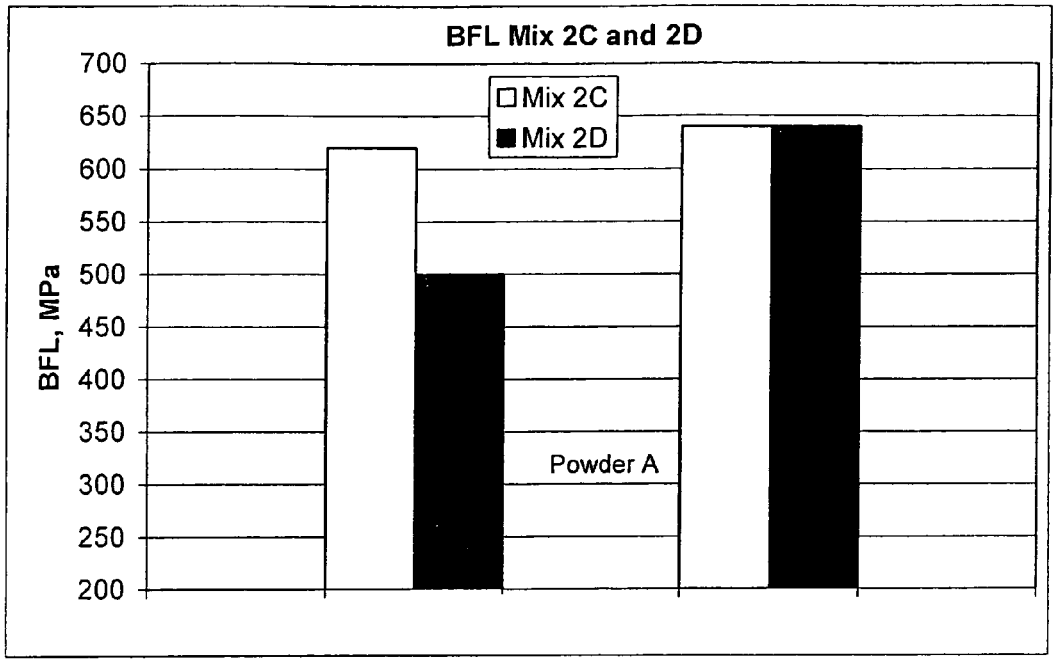
FIG. 4 shows the bending fatigue strength before and after surface densification process of samples produced from the mixes 2C and 2D according to example 2.

FIG. 4 shows the bending fatigue limit for both the surface densified samples and the samples which were not subjected to surface densification.

From FIG. 4 it can be concluded that surface densification of the samples produced with the coarser powder contributes to a much higher increase in BFL compared with the increase in BFL which was obtained by surface densification of the samples produced with a powder having a conventional particle size distribution.

Figure 5:
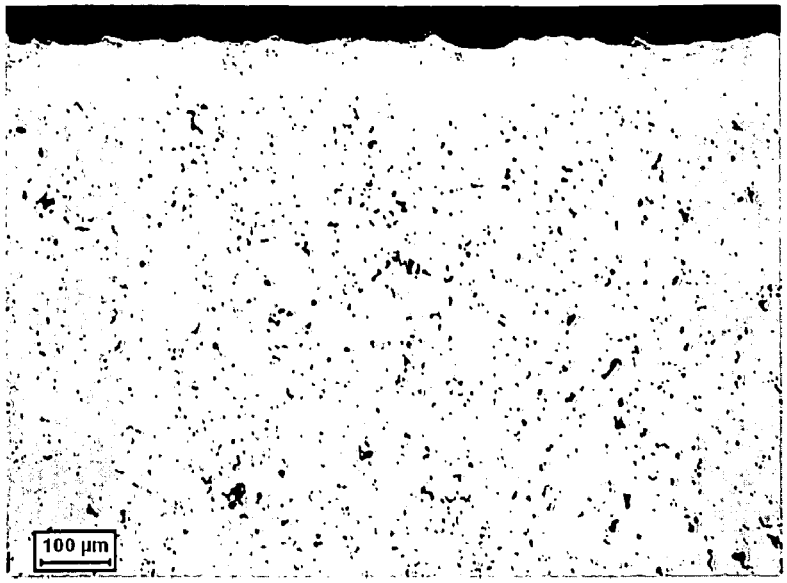
FIG. 5 is a light optical micrograph of a cross section of a surface densified sample prepared from mix 2C.
Figure 6:
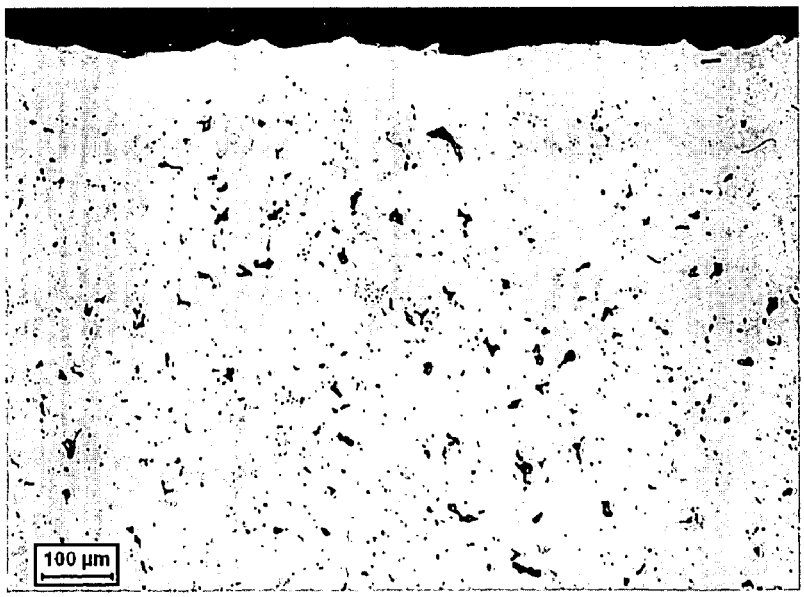
FIG. 6 is a light optical micrograph of a cross section of a surface densified sample prepared from mix 2D.

FIG. 5 is a light optical micrograph showing a cross section of a surface densified sample prepared from mix 2C and FIG. 6 is a similar micrograph from a surface densified sample prepared from mixture 2D.

Image analysis according to ASTM E 1245 of cross section of surface densified samples produced from sample 2C shows that about 50% of the total cross section pore area consists of pores having a surface area of 50 μm$^2$ or more, whereas the same measuring of surface densfied samples produced from mix 2D shows that about 50% of the total cross section area consists of pores having a surface area of 110 μm$^2$ or more.

The invention claimed is:

1. A sintered metal part which has a densified surface with a densification depth of at least 0.1 mm, a sintered density of at least 7.35 g/cm$^3$ and a core structure distinguished by the pore structure, wherein the core of the metal part has a pore structure wherein at least 50% of the pore area in a cross section consists of pores having a pore area of at least 100 μm$^2$, the metal part obtained by single pressing to at least 7.35-g/cm$^3$ and single sintering of a mixture of a coarse iron or iron-based powder, wherein the iron or iron-based powder has a particle size such that at most 10% of the particles are less than 45 μm, and optional additives.

2. Metal part according to claim 1 wherein the green density and the sintered density are at least 7.45 g/cm$^3$.

3. Method for producing powder metal parts having a densified surface, comprising the steps of:

uniaxially compacting an iron or iron-based powder having coarse particles to a density above 7.35 g/cm$^3$in a single compaction step at a compaction pressure of at least 700 MPa, the powder including a lubricant which is an organosilane selected from the group consisting of alkylakoxy or polyetheralkoxy silane, wherein the alkyl group of the alkylakoxy silane and the polyether chain of the polyetheralkoxy silane includes between 8 and 30 carbon atoms, and the alkoxy group includes 1-3 carbon atoms;

subjecting the parts to sintering in a single step at a temperature of at least 1100° C. to a density of at least 7.35 g/cm$^3$; and subjecting the parts to a surface densifying process whereby the surface densified parts are densified to a depth of at least 0.1 mm.

4. Method according to claim 3, wherein the powder includes alloying additives in an amount up to 5% by weight.

5. Method according to claim 4, wherein the alloying additives are at least one member selected from the group consisting of graphite, chromium, molybdenum, manganese, nickel and copper.

6. The method according to claim 3, wherein the organosilane is selected from the group consisting of octyl-tri-methoxy silane, hexadecyl-tri-methoxy silane and polyethylene ether-trimethoxy silane with 10 ethylene ether groups.

7. Method according to claim 3, wherein the iron-based powder is a pre-alloyed, water atomised powder.

8. Method according to claim 3, wherein the iron or iron-based powder has a particle size such that at most 10% of the particles are less than 45 μm.

9. Method according to claim 3, wherein the compaction is performed at a pressure of at least 800 MPa.

10. Method according to claim 3, wherein the sintering is performed at a temperature of at least 1200° C.

11. Method according to claim 3, wherein the compacted parts are sintered for a time of 15 to 60 minutes.

12. Method according to claim 3, wherein the compacted parts are sintered in an endogas atmosphere, a mixture of hydrogen and nitrogen or in vacuum.

13. Method according to claim 3, wherein surface densifying is performed by rolling.

14. Method according to claim 3, wherein the produced powder metal parts are gears, bearings, rolls, sprockets and shafts.

15. Metal part according to claim 1, wherein the green density and the sintered density are at least 7.5 g/cm$^3$.

16. Method according to claim 3, wherein the iron-based powder has a particle size such that at most 5% of the particles are less than 45 μm.

17. Method according to claim 3, wherein the compaction is performed at a pressure of at least 900 MPa.

18. Method according to claim 3, wherein the compaction is performed at a pressure of at least 1000 MPa.

19. Method according to claim 3, wherein the sintering is performed at a temperature of at least 1250° C.

20. Method according to claim 3, wherein the surface densified parts are densified to a depth of at least 0.2 mm.

21. Method according to claim 3, wherein the surface densified parts are densified to a depth of at least 0.3 mm.

22. Metal part according to claim 1, wherein the densification depth is at least 0.2 mm.

* * * * *